US005501196A

United States Patent [19]

Brunnhofer

[11] Patent Number: 5,501,196

[45] Date of Patent: Mar. 26, 1996

[54] FUEL-INJECTION SYSTEM FOR MOTOR-VEHICLE ENGINE

[75] Inventor: Erwin Brunnhofer, Fuldabrück, Germany

[73] Assignee: Technoflow Tube-Systems GmbH, Fuldabruck, Germany

[21] Appl. No.: 357,500

[22] Filed: Dec. 16, 1994

[30] Foreign Application Priority Data

Dec. 28, 1993 [DE] Germany ..... 43 44 775.9

[51] Int. Cl.[6] ..... F02M 37/04

[52] U.S. Cl. ..... 123/497; 123/514

[58] Field of Search ..... 123/458, 459, 123/456, 497, 514, 179.16, 541

[56] References Cited

U.S. PATENT DOCUMENTS

| | | | |
|---|---|---|---|
| 4,308,827 | 1/1982 | Roe | 123/541 |
| 4,565,173 | 1/1986 | Oshiage et al. | 123/458 |
| 4,628,881 | 12/1986 | Beck et al. | 123/458 |
| 4,646,706 | 3/1987 | Emmenthal | 123/459 |
| 4,777,921 | 10/1988 | Miyaki et al. | 123/458 |
| 4,800,859 | 1/1989 | Sagisaka et al. | 123/459 |
| 4,893,603 | 1/1990 | Siebels | 123/514 |
| 4,926,829 | 5/1990 | Tuckey | 123/514 |
| 4,940,034 | 7/1990 | Heim et al. | 123/497 |
| 5,055,758 | 10/1991 | Hock | 123/497 |
| 5,085,193 | 2/1992 | Morikawa | 123/458 |
| 5,207,203 | 5/1993 | Wagner et al. | 123/514 |
| 5,243,947 | 9/1993 | Yamamoto et al. | 123/458 |
| 5,284,119 | 2/1994 | Smitley | 123/497 |
| 5,313,924 | 5/1994 | Regueiro | 123/458 |
| 5,367,999 | 11/1994 | King et al. | 123/458 |
| 5,373,829 | 12/1994 | Schuers et al. | 123/514 |
| 5,398,655 | 3/1995 | Tuckey et al. | 123/514 |
| 5,406,922 | 4/1995 | Tuckey | 123/497 |
| 5,411,002 | 5/1995 | Smitley | 123/497 |

*Primary Examiner*—Thomas N. Moulis
*Attorney, Agent, or Firm*—Herbert Dubno; Andrew Wilford

[57] ABSTRACT

A motor-vehicle engine system has an internal-combustion four-cycle engine having a fuel-supply manifold and operable at variable speed with a fuel requirement dependent on speed, a substantially closed but vented fuel tank holding a supply of gasoline, a fuel pump having an input connected to the tank and an output, and a fuel-feed line connected between the fuel-pump output and the fuel-supply manifold. A controller connected to the engine and to the pump operates the fuel pump at a throughput rate equal to between 5% and 40%, preferably 10% to 30%, more than the instantaneous fuel requirements of the engine. A return line connected to the fuel tank is provided with an overpressure valve that opens and returns to the tank fuel in the manifold that is in excess of the engine's instantaneous requirements and thereby maintains a predetermined constant pressure in the fuel-supply manifold.

6 Claims, 1 Drawing Sheet

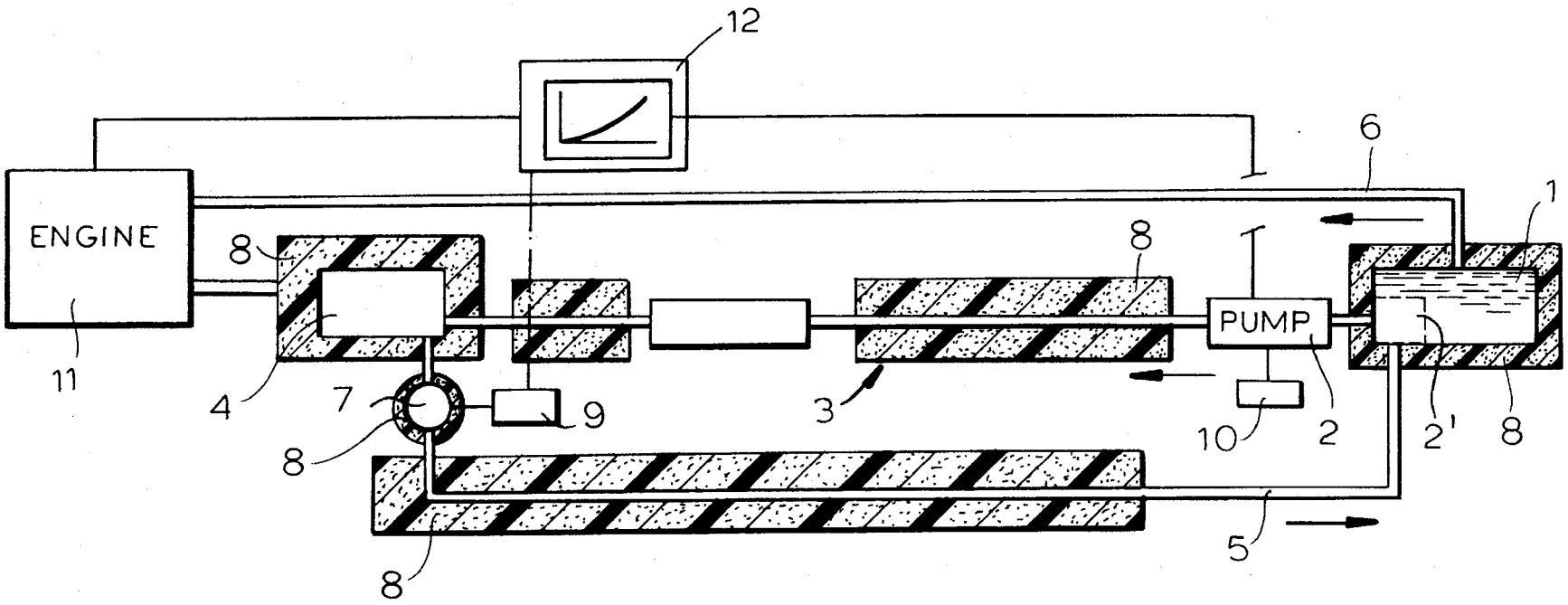
PUMP
ENGINE
1
2
2'
3
4
5
6
7
8
9
10
11
12

FUEL-INJECTION SYSTEM FOR MOTOR-VEHICLE ENGINE

SPECIFICATION

FIELD OF THE INVENTION

The present invention relates to a motor-vehicle engine system. More particularly this invention concerns a fuel-injection system for such an engine.

BACKGROUND OF THE INVENTION

A standard fuel-injected engine system has a four-cycle internal-combustion engine with a fuel-supply manifold connected via injectors to the individual combustion chambers, a fuel tank holding a supply of gasoline, a fuel-supply line leading from the tank to the fuel-supply manifold, and a pump in the line. The tank is normally closed but vented for pressure-equalization purposes into the air-intake manifold of the engine. A return line runs from the fuel-supply manifold back to the tank and an overpressure valve in this return line prevents excess pressure from building up in the fuel manifold. The tank is normally at atmospheric pressure, although it may be somewhat pressurized.

The disadvantage of this system is that the gasoline is moved about and heated considerably. The tank itself is normally juxtaposed with components of the exhaust system, and both the fuel-supply and return lines run along the muffler and other exhaust-system parts so that the fuel in them is heated. In addition the pump itself generates heat and is itself often mounted on or in the fuel tank so that it also heats the fuel. This heat can break down the fuel by vaporizing off the more highly volatile components of the gasoline.

OBJECTS OF THE INVENTION

It is therefore an object of the present invention to provide an improved fuel-injected engine system.

Another object is the provision of such an improved fuel-injected engine system which overcomes the above-given disadvantages, that is which avoids heat buildup in the fuel and that is otherwise more efficient than the prior-art systems.

SUMMARY OF THE INVENTION

A motor-vehicle engine system has according to the invention an internal-combustion four-cycle engine having a fuel-supply manifold and operable at variable speed with a fuel requirement dependent on speed, a substantially closed but vented fuel tank holding a supply of gasoline, a fuel pump having an input connected to the tank and an output, and a fuel-feed line connected between the fuel-pump output and the fuel-supply manifold. A controller connected to the engine and to the pump operates the fuel pump at a throughput rate equal to between 5% and 40%, preferably 10% to 30%, more than the instantaneous fuel requirements of the engine. A return line connected to the fuel tank is provided with an overpressure valve that opens and returns to the tank fuel in the manifold that is in excess of the engine's instantaneous requirements and thereby maintains a predetermined constant pressure in the fuel-supply manifold.

Thus with this invention the fuel has a short residence time in the supply line and therefore does not get too hot. The engine is supplied with all the fuel it needs.

According to the invention the controller temporarily opens the overpressure valve on startup of the engine. The pump has an efficiency of at least 80%. This pump can be in or outside the fuel tank. When inside the tank it is insulated from the fuel therein. To prevent excessive thinning of the fuel by heat insulation surrounds and thermally insulates the fuel tank, fuel-feed line, and return line from their surroundings. This insulation is an insulating plastic layer bonded to the fuel tank, fuel-feed line, and return line.

BRIEF DESCRIPTION OF THE DRAWING

The above and other objects, features, and advantages will become more readily apparent from the following description, reference being made to the accompanying drawing whose sole figure is a diagrammatic illustration of the invention.

SPECIFIC DESCRIPTION

As seen in the drawing, fuel is extracted from a fuel tank 1 by a fuel pump 2 and passed through a fuel-feed system here formed by a single line or conduit 3 to a fuel-supply manifold 4 connected to a four-cycle internal-combustion engine 11. The tank 1 is sealed and vented, as usual, via a line 6 that goes to the intake manifold of the engine 11. Excess pressure in the supply manifold 4 is bled off via an overpressure valve 7 and fed back to the tank 1 through a return line 5. As illustrated at 2', the pump can also be mounted inside the tank 1

A controller 12 of the engine 11 operates the pump 2 via an actuator 10 and the overpressure valve 7 via an actuator 9. The pump throughput rate is set by the controller 12 in accordance with the engine's need for fuel, so that pump 2 delivers to the manifold 4 between 5% and 40%, preferably between 10% and 30%, more fuel than the instantaneous needs of the engine. Thus the valve 7 is normally open, and the pump 2 may be operated to create a pressure pulse on startup to effect such opening of the valve 7.

All of the elements of the fuel system, including the tank 1, manifold 4, valve 7, and lines 3 and 5, are covered with insulating material 8. Here a polyurethane foam is used, although other thermal-insulating systems such as vacuum could be used. Polyurethane is particularly advantageous since the tank 1 and lines 3 and 5 are normally made at least partially of this material so the foam insulation adheres unitarily to these parts. The pump 2 is very efficient so that it operates cool. If it is mounted in the tank 1 as shown at 2' it is insulated from the fuel. No insulation 8 is provided on the pump 2 when it is outside the tank 1 so that what little heat it does generate is dissipated.

I claim:

1. A motor-vehicle engine system comprising:

an internal-combustion four-cycle engine having a fuel-supply manifold and operable at variable speed with a fuel requirement dependent on speed;

a substantially closed but vented fuel tank holding a supply of gasoline;

a fuel pump of an efficiency of at least 80% and having an input connected to the tank and an output;

a fuel-feed line connected between the fuel-pump output and the fuel-supply manifold;

control means connected to the engine and to the pump for operating the fuel pump at a throughput rate equal to between 5% and 40% more than the instantaneous fuel requirements of the engine;

a return line connected to the fuel tank;

an overpressure valve connected between the return line and the fuel-supply manifold; and means connected to the overpressure valve for opening same and returning to the tank fuel in the manifold that is in excess of the engine's instantaneous requirements and for maintaining a predetermined pressure in the fuel-supply manifold.

2. The engine system defined in claim 1 wherein the control means temporarily opens the overpressure valve on startup of the engine.

3. The engine system defined in claim 1 wherein the pump is in the tank.

4. The engine system defined in claim 1 wherein the pump is outside the tank.

5. The engine system defined in claim 1, further comprising:

insulation surrounding and thermally insulating the fuel tank, fuel-feed line, and return line from their surroundings.

6. The engine system defined in claim 5 wherein the insulation is an insulating plastic layer bonded to the fuel tank, fuel-feed line, and return line.

* * * * *